US005486057A

United States Patent [19]

Skinner et al.

[11] Patent Number: 5,486,057

[45] Date of Patent: Jan. 23, 1996

[54] MULTICOLOR PRINTER SYSTEM HAVING MULTIPLE PRINT HEADS

[75] Inventors: Donald K. Skinner, West Hills; Yoshi Yagi, North Hill; Wilfried Zogg, La Crescenta, all of Calif.

[73] Assignee: Eltron International, Inc., Simi Valley, Calif.

[21] Appl. No.: 240,260

[22] Filed: May 10, 1994

Related U.S. Application Data

[63] Continuation of Ser. No. 879,034, May 6, 1992, abandoned.

[51] Int. Cl.[6] ..... B41J 2/32

[52] U.S. Cl. ..... 400/120.02; 400/149; 400/188; 347/172; 347/173

[58] Field of Search ..... 400/120 MC, 120.01, 400/120.02, 120.16, 120.17, 188, 149; 347/171, 172, 173, 177, 178, 197, 198, 222

[56] References Cited

U.S. PATENT DOCUMENTS

| | | | |
|---|---|---|---|
| 4,091,913 | 5/1978 | Ku et al. | 400/249 |
| 4,462,704 | 7/1984 | Kurata et al. | 400/120.02 |
| 4,493,255 | 1/1985 | Fischer | 101/183 |
| 5,127,751 | 7/1992 | Kobayashi et al. | 400/231 |

FOREIGN PATENT DOCUMENTS

| | | | |
|---|---|---|---|
| 0069071 | 4/1982 | Japan | 400/188 |
| 0011181 | 1/1983 | Japan | 400/120 MC |
| 160176 | 9/1983 | Japan | 400/120 MC |
| 0083681 | 5/1984 | Japan | 400/120 MC |
| 0076288 | 5/1984 | Japan | 400/120 MC |
| 0202863 | 9/1986 | Japan | 400/188 |
| 22082 | 1/1990 | Japan | 400/120 MC |
| 3-53955 | 3/1991 | Japan | 400/188 |
| 5185661 | 7/1993 | Japan | 400/120 MC |

*Primary Examiner*—Ren Yan
*Assistant Examiner*—John S. Hilten
*Attorney, Agent, or Firm*—Freilich Hornbaker Rosen

[57] ABSTRACT

A multicolor thermal transfer printer system (20) is disclosed which prints computer controlled patterns on both faces of cards (22) (e.g. credit cards of polymer or paper stock). The system utilizes interdigitally arranged printer modules (30) which are dimensioned to transfer each card between drive rollers (34) and idler rollers (36) of adjacent printer modules. Each printer module has a microprocessor (28) which stores in memory (172) any pattern sent by a control computer (24). As each card passes through the printer module, thermal elements (101) in a print head (38) transfer ink from a transfer ribbon (32) to the card in accordance with the stored pattern. To conserve transfer ribbon it is moved past the print head only when the print head is in a print position. Each microprocessor reports status of its printer module such as end of ribbon, broken ribbon and card location.

14 Claims, 7 Drawing Sheets

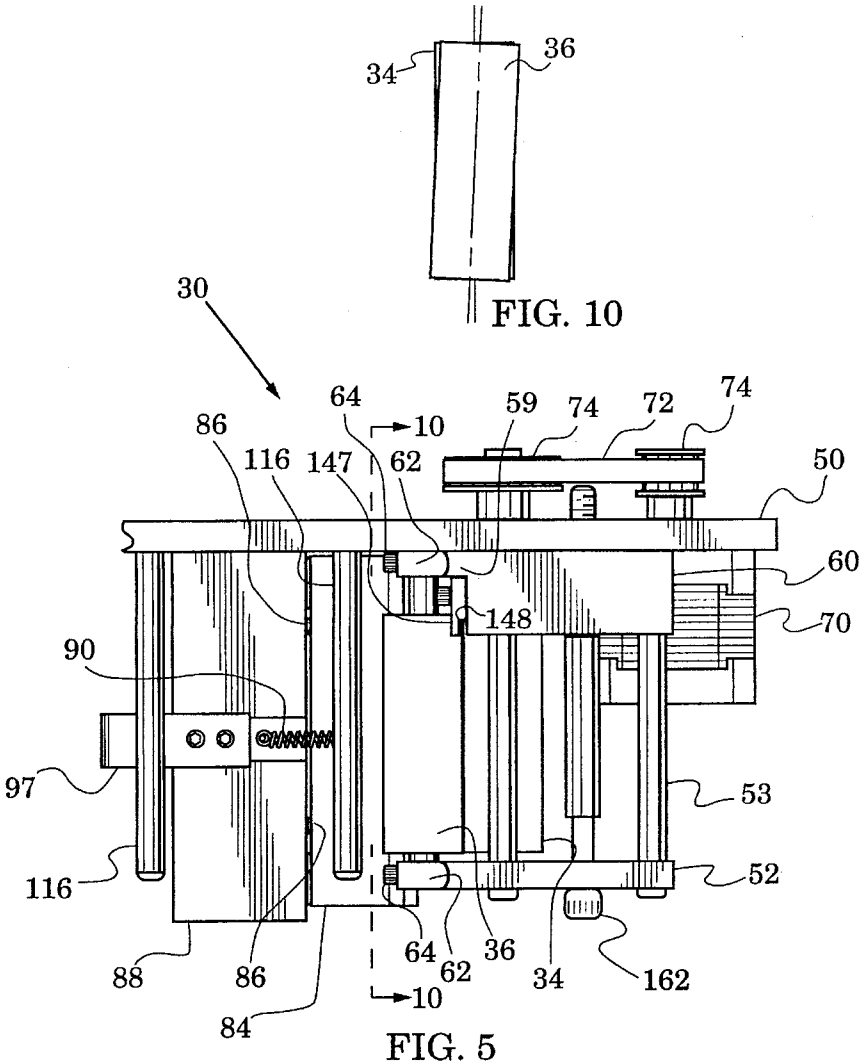
FIG. 10
FIG. 5
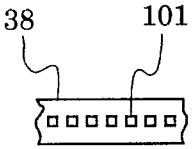
FIG. 8
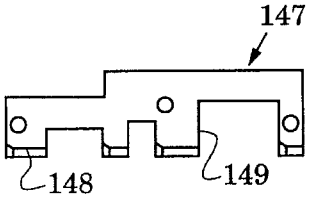
FIG. 9
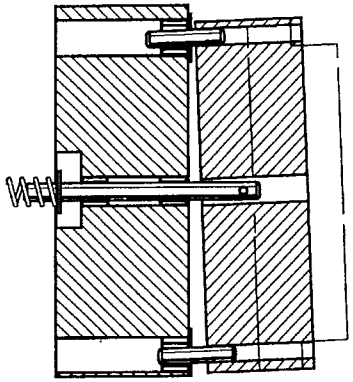
FIG. 7B
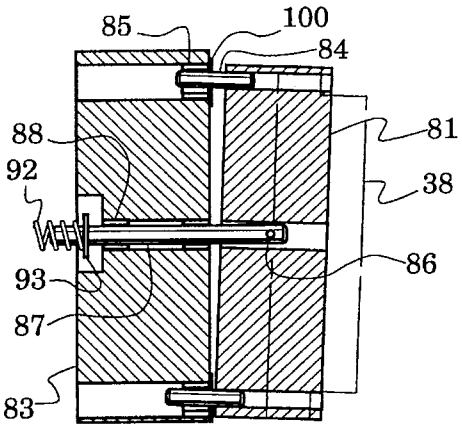
FIG. 7A

MULTICOLOR PRINTER SYSTEM HAVING MULTIPLE PRINT HEADS

This application is a continuation of U.S. Ser. No. 07/879,034, filed May 6, 1992, now abandoned.

FIELD OF THE INVENTION

The present invention relates generally to printers and more particularly to computer controlled printers for multicolor printing on both faces of a card.

BACKGROUND OF THE INVENTION

Many applications exist for multicolor printing on both faces of card stock (e.g. transit tickets). Such printing may be envisioned with a variety of printing techniques (e.g. impact, laser, ink jet, thermal transfer).

SUMMARY OF THE INVENTION

The present invention is directed to a printing system for multicolor printing on both faces of a card.

A system in accordance with the invention is characterized by a plurality of printer modules arranged to transport a card along a print path from an upstream entrance to a downstream exit. The printer modules are arranged in first and second sets with the first set having print heads located adjacent to one side of said path and the second set having print heads located adjacent to the opposite side of said path.

In accordance with the invention, each of said first and second printer module sets includes a plurality of printer modules, each printer module being capable of printing a single color. In accordance with a preferred system embodiment, the modules of each set are configured to print different colors to enable the system to print a multicolored pattern on each face of a card transported along said print path.

In accordance with a preferred embodiment of the invention, the printer modules are substantially identically constructed and each includes a drive station and a print station spaced from each other to define a print subpath. In a preferred system embodiment, the plurality of printer modules are arranged so that their respective subpaths serially form said print path extending from said upstream entrance to said downstream exit. The spacing between adjacent printer module drive stations is selected to be slightly less than the minimum length of a card intended to be transported along said print path.

The novel features of the invention are set forth with particularity in the appended claims. The invention will be best understood from the following description when read in conjunction with the accompanying drawings.

BRIEF DESCRIPTION OF DRAWINGS

FIG. 5 is a view along the plane 5—5 of FIG. 2;

FIGS. 7A and 7B are sectional views of the print head carrier and carrier support of the thermal transfer printer module of FIG. 2;

FIG. 8 is an enlarged view along the plane 8—8 of FIG. 2;

FIG. 9 is a plan view of a card guide in the thermal transfer printer module of FIG. 2;

FIG. 10 is a partial view along the plane 10—10 of FIG. 5;

DESCRIPTION OF THE PREFERRED EMBODIMENTS

Figure 1:
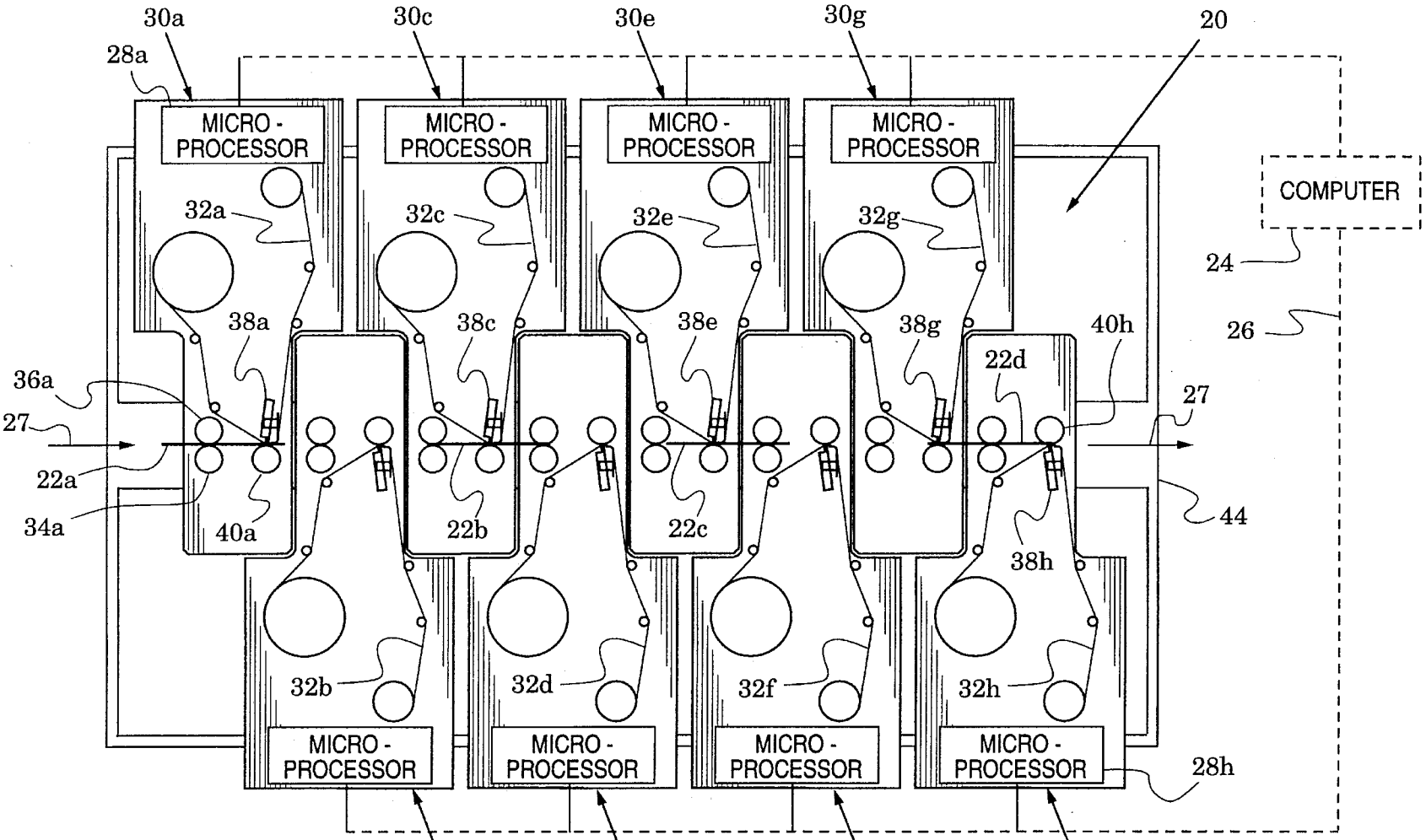
FIG. 1 is a top plan view of a preferred multicolor thermal transfer system embodiment, in accordance with the present invention, connected to a control computer.

FIG. 1 is a top plan view of a printer system 20, in accordance with the present invention, for printing multicolor patterns on both faces of cards 22 in accordance with instructions from a remote computer 24. The computer 24 via interface 26, controls multiple microprocessors 28, one in each of a plurality of printer modules 30.

The cards 22 pass through the printer system 20 along a print path defined between an upstream entrance indicated by the arrow 27' and a downstream exit indicated by the arrow 27". Each printer module 30 is configured to print a pattern in one of a plurality of different colors.

In the system embodiment 20, printer modules 30*a*, 30*c*, 30*e* and 30*g* form a first set arranged to print, each in a different color, a first face of each card 22 and printer modules 30*b*, 30*d*, 30*f* and 30*h* form a second set arranged to print, each in a different color, the opposite face of each card 22. Although the system embodiment 20 is configured and dimensioned to print 4 colors (e.g. red, green, blue, yellow) on each face of cards sized approximately 2⅛" by 3⅜" (credit card size), embodiments of the invention are, in general, configured to print n and m colors on, respectively, a first and second face of cards of any size.

In the system 20, each printer module 30 has a drive station where a drive roller 34 and an idler roller 36 drive a card 22 therebetween and a print station where a print head 38 prints on a face of the card 22 as it is supported by a platen 40. The drive station and print station of each printer module 30 form a subpath of the system print path.

To facilitate an understanding of the system 20, cards 22*a*, 22*b*, 22*c* and 22*d* are positioned, in FIG. 1, along the print path in various stages of the printing process. During an actual printing run, the cards 22 are typically closer together (e.g. approximately one quarter inch apart).

Card 22*a* is shown being driven by a drive roller 34*a* and an idler roller 36*a* between a print head 38*a* and a platen 40*a*. Printer module 30*a* is, therefore, ready to begin transferring a colored ink from a transfer ribbon 32*a* to a first face of the card 22*a* in response to the pattern previously loaded into the printer module memory from the computer 24 via the microprocessor 28*a*.

Cards 22*b*, 22*c* and 22*d* are each shown progressively further advanced relative to, respectively, print heads 38*c*, 38*e* and 38*g* and thus printer modules 30*c*, 30*e* and 30*g* are also in position to apply colored ink from transfer ribbons 32*c*, 32*e* and 32*g* to the first face of the cards 22 in response to the pattern loaded into their respective microprocessors.

Card 22*d* is just beginning to pass between print head 38*h* and platen 40*h* so that printer module 30*h* can transfer colored ink from transfer ribbon 32*h* to the second face of the card in accordance with the pattern loaded into its microprocessor 28*h*.

Describing, now, the arrangement of the system 20, the first set of printer modules 30*a*, 30*c*, 30*e* and 30*g* are arranged in an interdigital relationship with the second set of printer modules 30*b*, 30*d*, 30*f* and 30*h*. The printer modules are fixed on a mounting frame 44, to allow each drive roller 34 and corresponding idler roller 36 to receive a card 22 from the print head 38 and platen 40 of the adjacent upstream printer module as is shown by the cards 22*b*, 22*c* and 22*d*.

In addition, the printer modules 30 are dimensioned to position the drive roller 34 and idler roller 36 of one printer module less than the length of the card 22 from the drive roller 34 and idler roller 36 of an adjacent printer module to facilitate passing the card therebetween. This is illustrated by the position of card 22*b*.

A printer module 30, and its functions in the system 20, are now described in greater detail by reference to FIGS. 2, 3 and 4, which are, respectively, top plan, side elevation, and bottom plan views, FIG. 5 which is a view along the plane 5—5 of FIG. 2, and FIG. 6 which is a view similar to FIG. 2. These figures illustrate one of the printer modules 30*b*, 30*d*, 30*f* and 30*h*. The printer modules 30*a*, 30*c*, 30*e* and 30*g* differ, in general, by being assembled as a mirror image of the illustrated printer module. The transfer ribbon 32 is shown only in FIGS. 2 and 6 for clarity of illustration.

Figure 3:
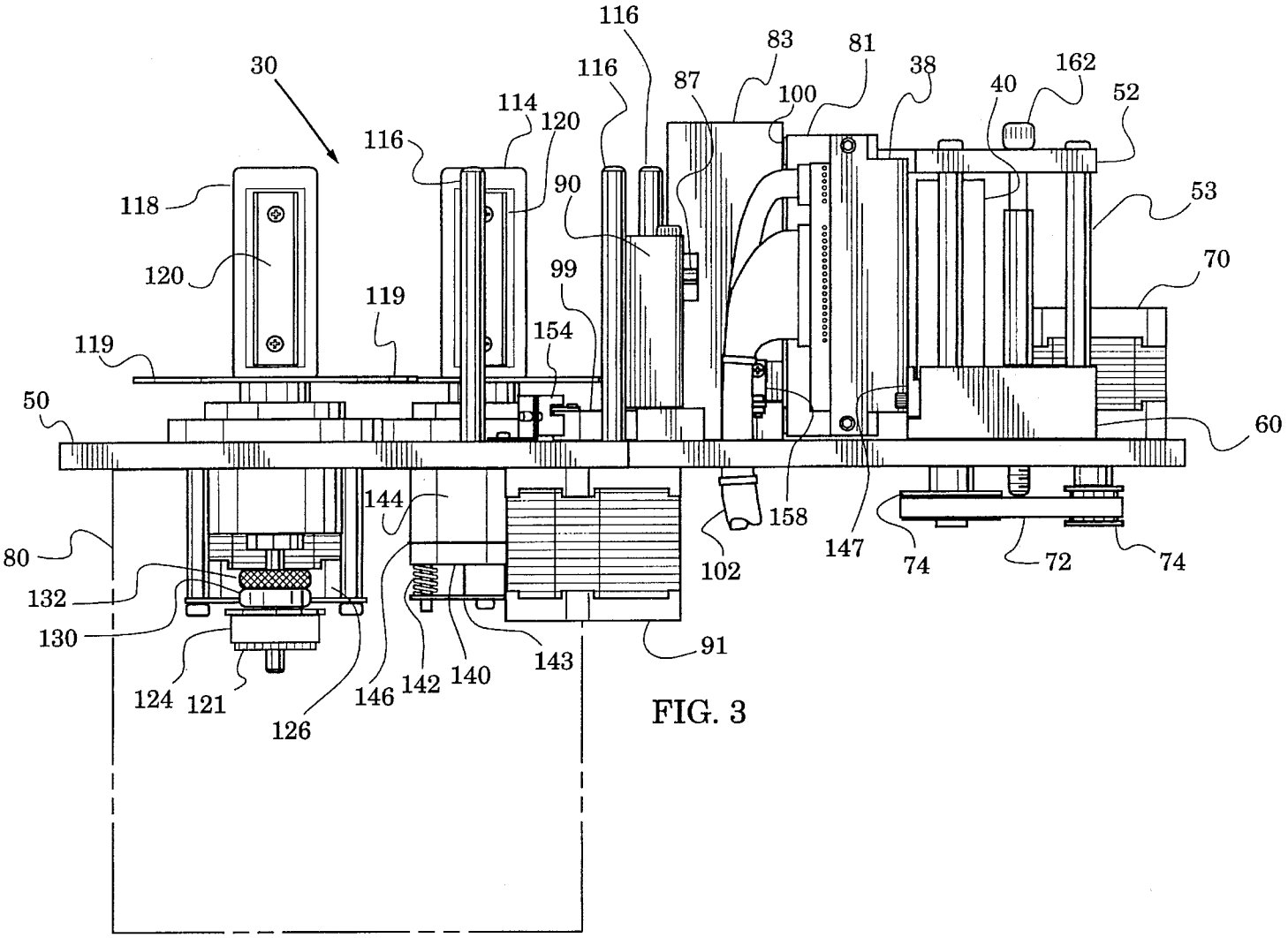
FIG. 3 is a side elevation view of the thermal transfer printer module of FIG. 2.
Figure 4:
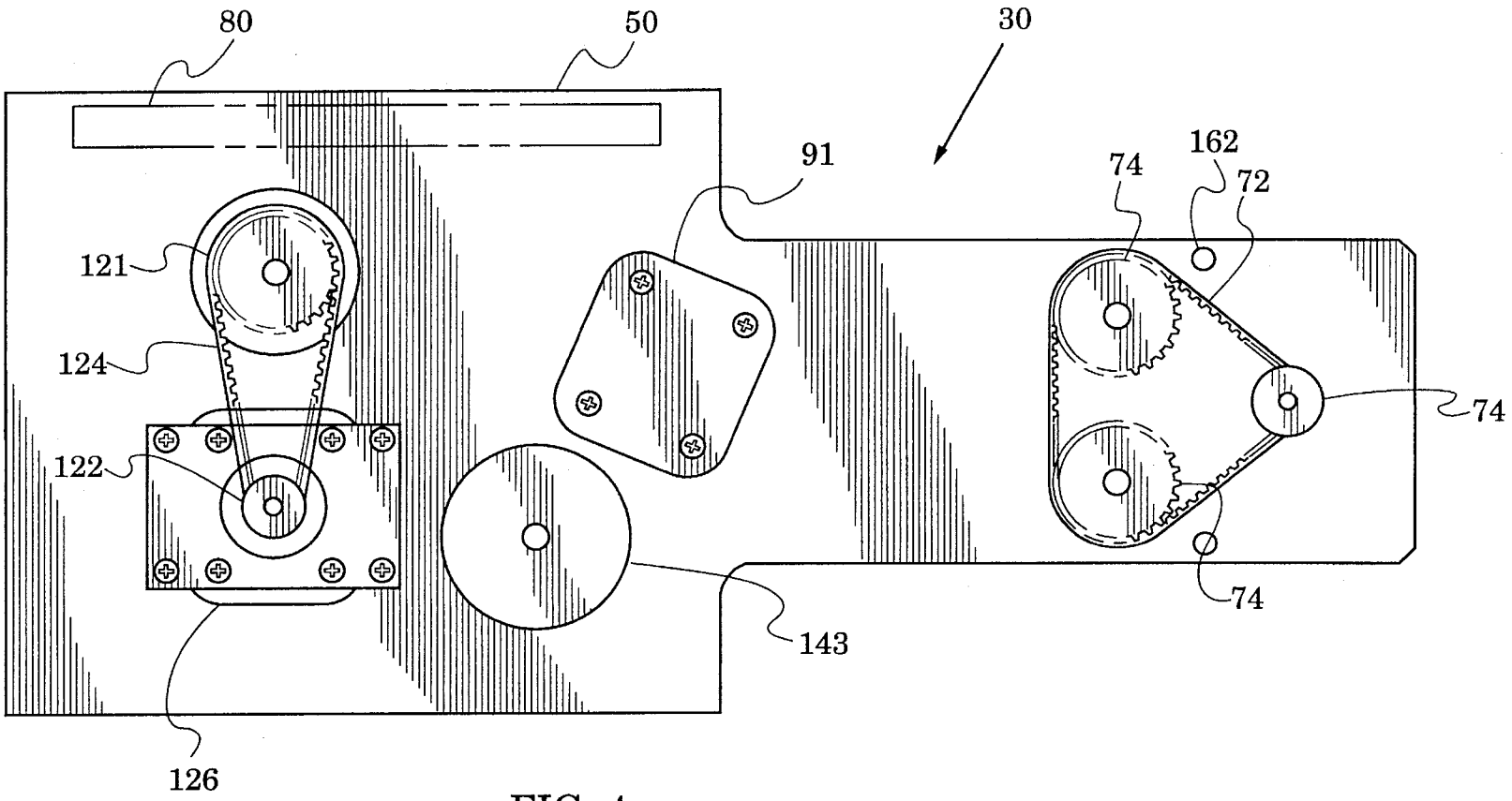
FIG. 4 is a bottom plan view of the thermal transfer printer module of FIG. 2.

In these views, the drive roller 34 and platen 40 are shown rotatably mounted in ball bearings 46 fixed in a base plate 50 and a roller top plate 52 spaced from the base plate on spacer rods 53 (seen in FIGS. 3, 5). The idler roller 36 has sintered bronze bearings 54, each defining at least one flat 56 which is received in a slot 58 in the roller top plate 52 and an arm 59 of a base member 60. Blade springs 62 are mounted in the base member 60 and top plate 52 by screws 64 so as to contact the bearing 54 and bias the idler roller 36 against the drive roller 34 thus insuring that the two rollers firmly grip a card therebetween as shown by card 22*a* in FIG. 1.

The drive roller 36 and the platen 40 are driven by a card drive stepper motor 70 through a toothed drive belt 72 meshing with three toothed wheels 74. The stepper motor 70 thus allows precise movement control of the card 22 by the microprocessor (28 in FIG. 1) as will be further described below. The microprocessor 28 is part of the printer module electronics mounted on a circuit card 80 installed on the base plate 50 in the position shown in broken lines in FIGS. 3 and 4.

Figure 2:
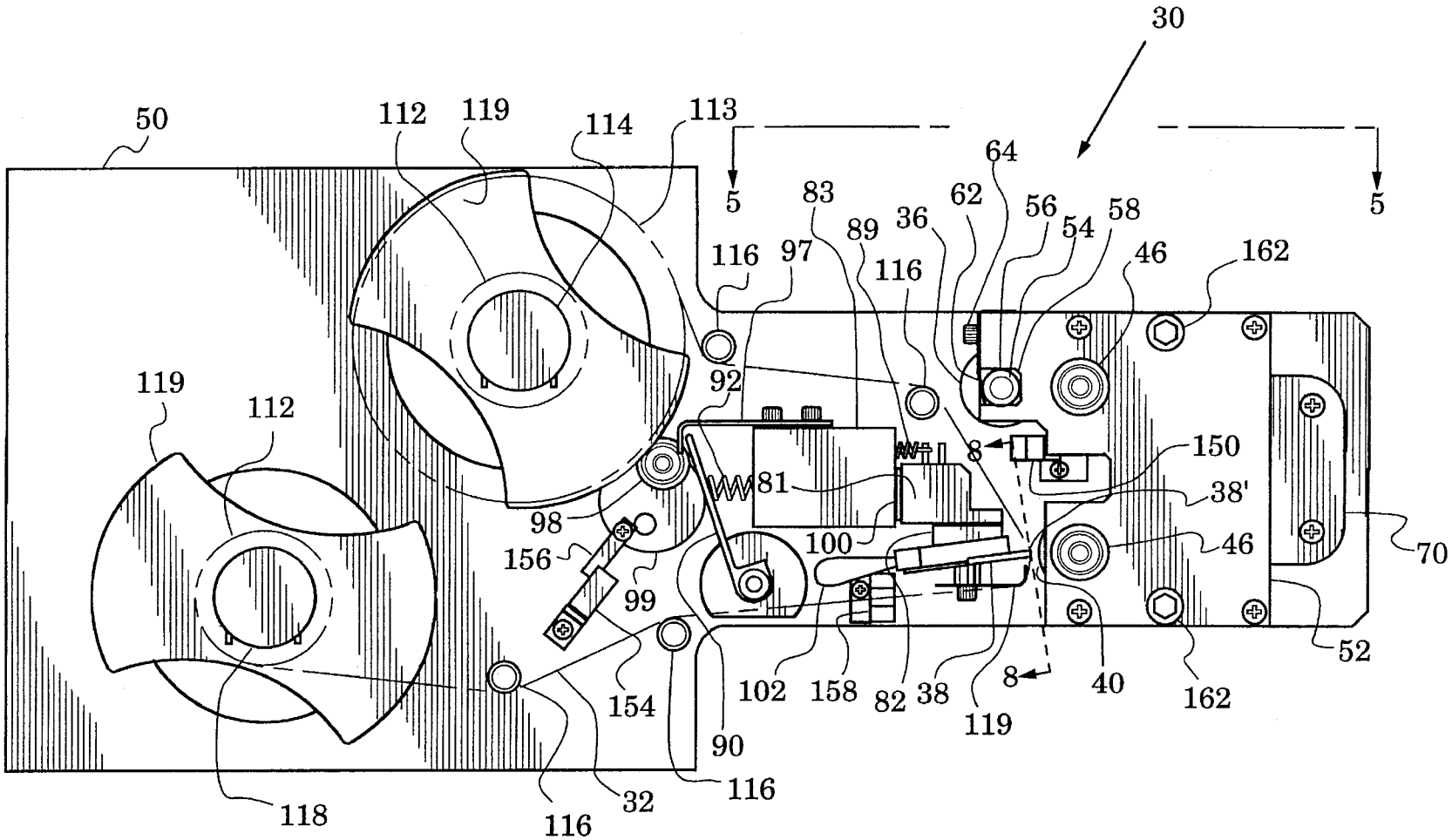
FIG. 2 is a top plan view of a thermal transfer printer module in the system of FIG. 1.
Figure 6:
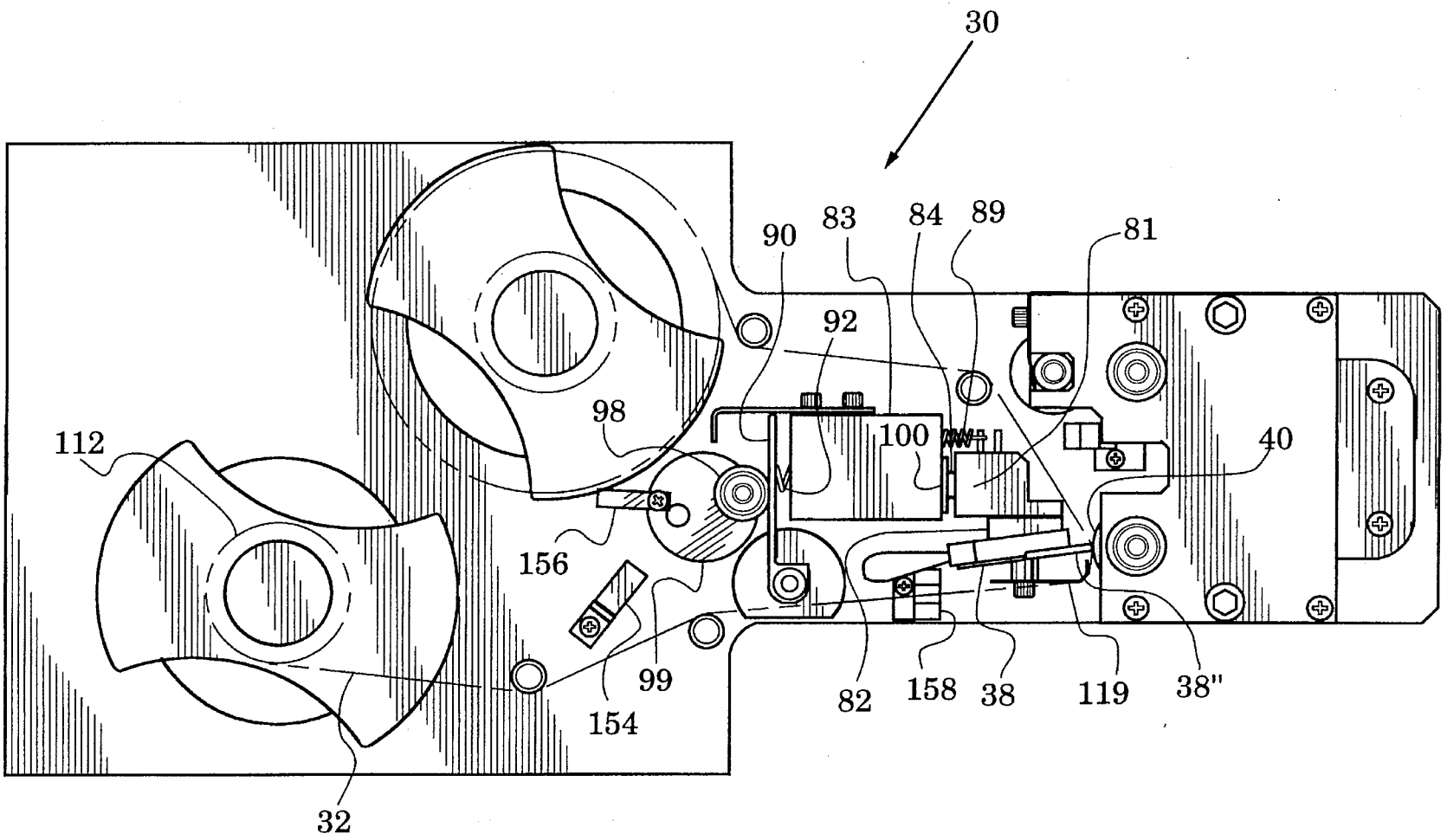
FIG. 6 is a view similar to FIG. 2.

The print head 38 is shown in a ready position 38' spaced from the platen 40 in FIG. 2 and in a print position 38" abutting the platen 40 in FIG. 6. The print head is attached to a carrier 81 by means of a spacer 82 which is beveled to hold the print head 38 at an angle, relative to the platen 40, that facilitates passage of the print transfer ribbon 32 therebetween.

The carrier 81 is slidably mounted in a carrier support 83 attached to the base plate 50. As best seen in the sectional views FIGS. 7A and 7B, a pair of pins 84 are pressed into the carrier 81 and are received in sintered bronze sleeves 85 pressed into the carrier support 83. The carrier 81, by means of a pivot pin 86 pressed therein, is rotatably mounted on a push rod 87 which is received through sintered bronze sleeves 88 in the carrier support 83. Thus the carrier 81 can rotate as illustrated in FIGS. 7A and 7B allowing the print head 38 (shown in broken lines) to align with the platen 40. The sleeves 85 closely receive the pins 84 horizontally but are elongated vertically to allow the carrier rotation.

A spring 89 urges the print head 38 to the ready position 38' of FIG. 2. A gate 90, rotatably mounted in the base plate 50, is operated by a print head drive stepper motor 91 to urge, through a pressure spring 92 bearing against a collar 93 of the push rod 87 (shown in FIGS. 7A, 7B), the print head to the print position 38" of FIG. 6. The gate 90 ready position is established by a stop 97 attached to the carrier support 83. Contact between the print head drive motor 91 and the gate 90 is by means of a cam roller 98 rotatably mounted on an off center cam 99. Felt pads 100 are bonded to the carrier support 83 to dampen vibrations of the carrier 81.

FIG. 8 is an enlarged view along the plane 8—8 of FIG. 2 illustrating the linearly arranged thermal elements 101 of the print head 38. Each thermal element 101 can be separately energized (heated by a current pulse) to transfer a dot of ink from the print transfer ribbon 32 to a card (22 in FIG. 1). The heater elements 101 are controlled, via a wire harness 102, by the microprocessor (28 in FIG. 1) with stored instructions from the computer (24 in FIG. 1). In the system embodiment 20 the thermal elements 101 are spaced approximately ⅛ millimeter apart and they are energized in columns every ⅛ millimeter of card travel. Thus the system 20 can print ink dots in a 8×8 matrix in every square millimeter of card surface.

In FIGS. 2 and 6, the transfer ribbon 32, prewound on a cardboard core 112 to a diameter 113, is seen to be threaded from a supply spool 114 about transfer ribbon guides 116 and the print head 38 to a takeup spool 118 (for clarity of illustration the transfer ribbon and core are shown in broken lines). A print head guide 119 directs the transfer ribbon away from the print head 38. The spools 114, 118 terminate at one end in a disc 119 which is scalloped to facilitate grasping the transfer ribbon for removal from the spools. Spring loaded clips 120 prevent slippage between the ribbon cores 112 and the spools 114, 118.

The takeup spool 118 is powered, via toothed gears 121, 122 and toothed belt 124, by a transfer ribbon drive stepper motor 126. A clutch 130, containing spring loaded plates, can be adjusted by a threaded knob 132 to set the torque applied to the transfer ribbon 32. The transfer ribbon 32 is thin (e.g. 6 microns) and can be broken if the torque applied is too great.

A brake shoe 140 (shown in FIG. 3), attached to the supply spool 114, is urged by springs 142 away from a cover plate 143 to abut a fixed spool base 144 through a felt washer 146. The clutch 130 on the takeup spool 118 and the brake 140 on the supply spool 114 facilitate the maintenance of a constant tension in the transfer ribbon 32.

Synchronous feeding of the transfer ribbon 32 and cards (22 in FIG. 1) between the print head 38 and platen 40 is a function of the microprocessor controlled transfer ribbon drive motor 126 and card drive motor 70. The pressure of the print head 38 and platen 40 cause the transfer ribbon 38 to move synchronously with the cards which are moving at a constant speed due to friction with the drive roller 34 and platen 40. Since the takeup spool 118 rotates at a constant speed, the clutch 130 adjusts for the difference in constant transfer ribbon speed and a changing transfer ribbon diameter on the takeup spool 118.

The vertical position of a card (22 in FIG. 1) is set relative to the print head 38 by a slotted card guide 147 attached to the base member 60 (for clarity of illustration the guide 147 is shown only in FIGS. 3 and 5). The guide 147 is shown in the plan view of FIG. 9 to have a step 148 to align the cards. The step 148 is beveled along leading edges to smoothly receive the cards and the guide defines notches 149 to clear the drive roller 34, idler roller 36, platen 40 and card sensor 150.

FIG. 10 is a view along the line 10—10 of FIG. 5 illustrating that the idler roller 36 is rotated relative to the drive roller 34. Thus, the idler roller 36 is rotated from a line normal to the guide 147 to urge the cards 22 downward against the guide 147. The rotation is less than five degrees with a preferred range of less than one degree (for clarity of illustration, the rotation shown in FIG. 10 is exagerated).

The lateral position of the card is sensed by the microprocessor when the leading edge of the card enters a card sensor 150 (shown in FIG. 2). The sensor is a slotted optical switch containing a light emitting diode (emitting in the infrared portion of the electromagnetic spectrum) and a photologic sensor. A similar infrared slotted optical switch forms the print head sensor 154, through which a flag 156, attached to the print head cam 99, is positioned when the print head 38 is in the ready position 38' as shown in FIG. 2.

The transfer ribbon 32 is seen in FIGS. 2 and 6 to pass through the ribbon sensor 158. This sensor is designed to sense an ink clear section, which is preformed near the end of the transfer ribbon 32, to indicate that the ribbon needs to be changed. The ink coated portions of the thin transfer ribbon 32 are substantially translucent and may be, as described above, of various colors. Therefore, this sensor is constructed using a light emitting diode that emits in the visible light portion of the electromagnetic spectrum and whose energy output is set by adjusting the electrical current flowing therethrough. By this adjustment the remnant light striking the photologic sensor is set to cross its threshold when a clear area of various colored transfer ribbons pass through the sensor.

The printer module 30 has two attachment bolts 162 passed through the top plate 52 and base plate 50 for attachment to the mounting frame (44 in FIG. 1).

Figure 11:
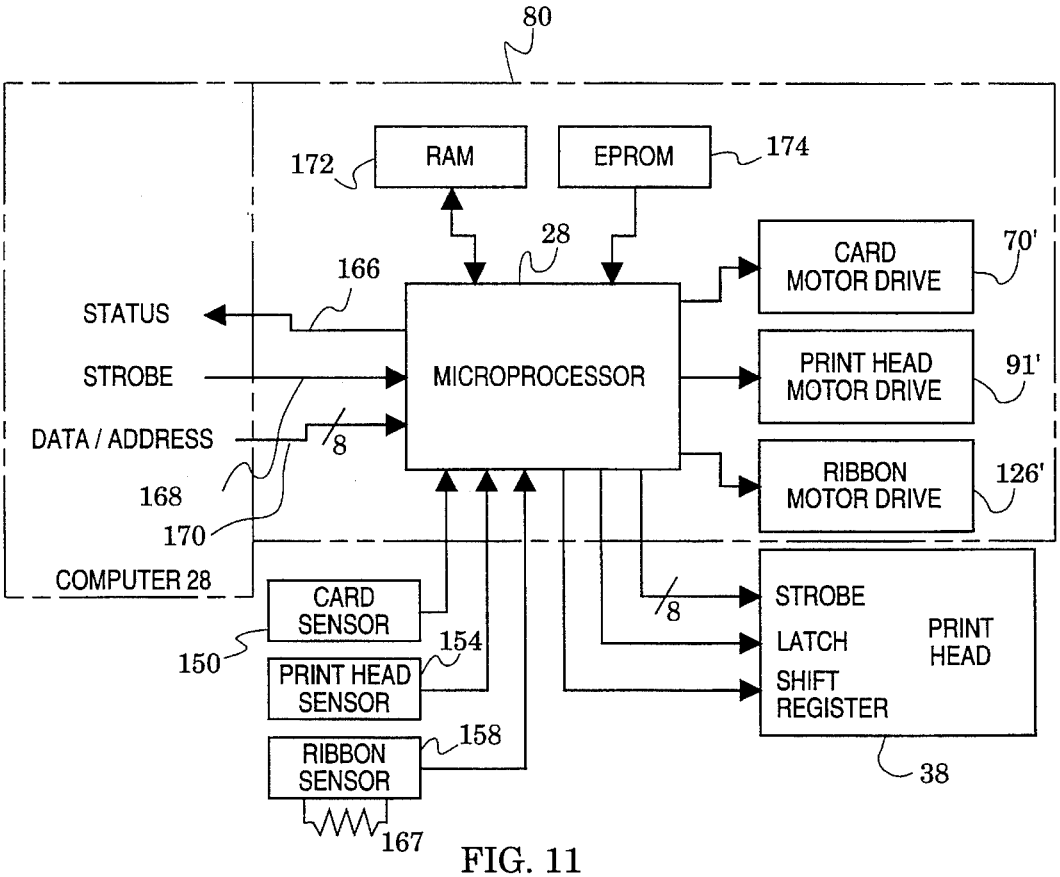
FIG. 11 is an electrical block diagram of the thermal transfer printer module of FIG. 2 and its interface with the control computer of FIG. 1.

FIG. 11 is an electrical block diagram of the system 20 illustrating the interface of the electronics on the circuit card 80 (shown in FIGS. 3 and 4) with the rest of the system.

As described above, the microprocessor 28 monitors card 22 lateral position via the card sensor 150 (shown in FIG. 2), print head 38 position via the print head sensor 154 (shown in FIGS. 2, and 6) and transfer ribbon 32 status via the ribbon sensor 158 (shown in FIGS. 2, 3 and 6). By means of a clocked timer the microprocessor 28 derives the time during which an ink coated portion of the transfer ribbon is not sensed by the sensor 158. If this time is in accordance with the ribbon speed and the known distance of the ink free warning portion near the tape end, the microprocessor 28 reports over its output status lines 166 that the transfer ribbon 32 is nearing its end. If the time is excessive the microprocessor 28 reports that the transfer ribbon 32 is broken. The current through the print head sensor 154 light emitting diode is set, as described above, by selecting the value of resistor 167.

The computer 24 is connected to all printer modules 30 via a strobe line 168 and an eight bit parallel data/address line 170. The computer 24 uses these lines to first address a specific one of the printer modules 30 and then load eight bit data bytes into the microprocessor random access memory 172. Each byte controls eight of the thermal elements 101 illustrated in the print head 38 of FIG. 7.

Figure 12:
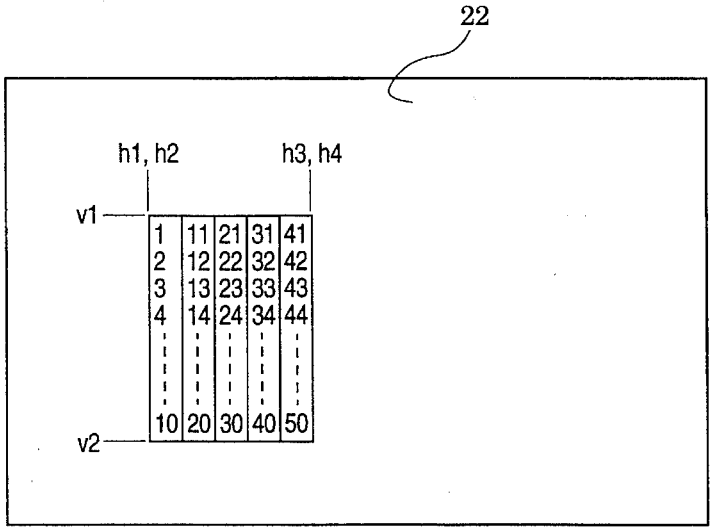
FIG. 12 is a byte plan for loading graphic images to be printed on one face of a card by the printer module of FIG. 2.

FIG. 12 illustrates a hypothetical example in which the microprocessor memory 172 is loaded with bytes 1–50 representing pattern data to be printed in an area of a card 22. In addition to the bytes, the computer 24 also designates the area by loading the least significant byte h1 and most significant byte h2 of the horizontal start column and similar bytes h3, h4 for the horizontal end column. Similar vertical start and end bytes v1 and v2 are also placed in the memory 172. The area to be printed in this example is greatly enlarged for clarity of illustration.

The microprocessor 28 controls the stepper motors 70, 91 and 126 that drive the card 22, move the print head to ready and print positions 38', 38" and start and stop the ribbon takeup spool 118. These stepper motors are controlled through motor drives 70', 91' and 126'. Once the card sensor 150 has reported the lateral position of a card 22, the microprocessor 28 continues moving the card via the card motor drive 70' and places the print head 38 into the print position 38" (shown in FIG. 6) slightly ahead of the horizontal location on the card designated by h1, h2 because movement of the print head requires a finite amount of time.

The microprocessor loads and latches the bytes 1–10 into the print head shift register. When the print head is aligned with the address of the first column to be printed, the microprocessor strobes the print head which energizes the thermal elements according to the latched byte pattern. This process is repeated for each column of pattern data through the horizontal address h3, h4. The microprocessor 28 then places the print head 38 into the ready position 38' (shown in FIG. 2). Thus the transfer ribbon 32 runs for only those areas of each card that are printed.

The microprocessor 28 runs the takeup spool motor 126 to drive the takeup spool 118 from a time substantially equal to the movement of the print head to the print position to a time somewhat after the movement of the print head to the ready position to insure ribbon tension is maintained and that the ribbon 32 is smoothly wound onto the takeup spool 118.

In the printer system embodiment 20, a total of 624 columns each having 46 bytes can be printed on one face of each card for a total of 28,704 bytes. The pattern for a subsequent card is stored while a card is being printed requiring a total of 59,408 bytes of storage. Consequently the random access memory 172 has room for 64 k of bytes (two 32 k×8 RAM's).

The operating instructions for the microprocessor 28 are stored in an electronically programable memory 174. Status reported by the microprocessor 28 over the status lines 166, in addition to transfer ribbon status, includes card jam, RAM buffer error, and the status of the three sensors 150, 154 and 158. Although it is anticipated that a microprocessor is used in the system 20 to implement the described printing of patterns, it is recognized that other circuit embodiments could be used (e.g. discrete hardwired circuits).

From the foregoing it should now be recognized that a multicolor thermal transfer system embodiment has been disclosed herein especially suited for colored printing on both faces of a card of typical credit card size. The teachings of the invention are extendable to printing m and n colors on both faces of a card of any size. An apparatus in accordance with the present invention facilitates changing the pattern for each card processed through the system.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. A system for successively transporting discrete cards, each card having a predetermined length, along a card path from an upstream entrance to a downstream exit, and for printing on both faces of each card as it is being transported along said path, said system comprising:

a plurality of substantially identical printer modules arranged in succession along a path, each of said printer modules including;

(a) print means including a transfer ribbon for printing one of a plurality of colors on a face of a card transported therepast; and (b) drive means for incrementally transporting each card along a portion of said path, past said print means, to the drive means of a succeeding printer module;

said plurality of printer modules arranged in succession along said path alternately comprising a printer module from a first set having its print means mounted adjacent a first side of said path to print on a first face of each card transported therepast, and a printer module from a second set having its print means mounted adjacent a second side of said path to print on a second face of each card transported therepast, successive ones of said printer modules being closely positioned so that the respective drive means thereof are spaced by a distance less than said predetermined card length.

2. The system of claim 1 wherein the printer modules of a set each print in a different color.

3. The system of claim 1 wherein the printer modules of said first set are arranged in an interdigital relationship with the printer modules of said second set.

4. The system of claim 1 wherein each of said printer modules further includes microprocessor means for controlling said print means and said drive means to print a pattern in accordance with instructions originating external to said system.

5. The system of claim 4 wherein each of said drive means comprises:

a drive roller mounted for rotation about an axis oriented perpendicular to said card path;

an idler roller mounted for rotation about an axis oriented perpendicular to said card path;

means mounting said drive roller and said idler roller in close proximity to one another to respectively engage first and second faces of each card passed therebetween for transporting each card along said path.

6. The system of claim 5 wherein each of said print means comprises:

a print head configured to print on an adjacent face of a card transported therepast along said card path;

means mounting said print head for movement between a ready position and a print position;

means, responsive to said microprocessor means, for a transfer ribbon mounted for movement along a ribbon path between said print head and said card path; and means for moving said ribbon along said ribbon path only when said print head is in said print position.

7. A method for multicolor printing on first and second faces of a discrete card transported along a print path past a plurality of printer modules, the method comprising the steps of:

disposing a plurality of substantially identical printer modules in succession alternately along opposite first and second sides of a path;

providing each of said printer modules with a drive means to transport a card along said path to a succeeding printer module;

configuring each of said printer modules to print one of a plurality of colors on a face of the card transported therepast; and locating said printer modules in first and second sets respectively located on opposite first and second sides of said path with the printer modules of said first set positioned to print on the first face of said card and the printer modules of said second set positioned to print on the second face of said card.

8. The method of claim 7 further comprising the step of controlling each of said printer modules with a microprocessor to print a pattern in accordance with instructions originating external to said printer modules.

9. A system for successively transporting discrete cards, each card having a predetermined length, along a card path from an upstream entrance to a downstream exit, and for printing on both faces of each card while it is being transported along said path, said system comprising:

a plurality of substantially identical printer modules, each printer module including a drive station and a print station spaced from one another to define a subpath;

means mounting said plurality of printer modules in succession alternately along first and second sides of said path with the subpaths of adjacent modules aligned to collectively define said card path and with the drive stations of adjacent modules being spaced by a distance less than said predetermined card length;

each of said drive stations including (1) roller means mounted for rotation about an axis extending substantially perpendicular to said card path and defining a circumferential surface for engaging a card to move it along said path and (2) card drive means for drivingly rotating said roller means to transport a card to the drive station of an adjacent printer module;

each of said print stations including (1) print head means mounted for movement toward and away from said card path between a print position and a ready position, (2) a transfer ribbon mounted for movement along a ribbon path extending between said print head means and said card path, and (3) ribbon drive means for moving said ribbon along said ribbon path only when said print head is in said print position.

10. The system of claim 9 wherein each of said printer modules further includes microprocessor means for controlling said print head means and said card drive means to print a pattern in accordance with instructions originating external to said system.

11. The system of claim 9 wherein each of said printer modules further comprises;

means for detecting ink coated portion of said transfer ribbon;

timer means, responsive to said detecting means, for measuring elapsed time of absence of said ink coated portions of the moving transfer ribbon; and means for reporting out of said printer module that said transfer ribbon is near its end if said elapsed time is less than a threshold time and that said transfer ribbon is broken if said elapsed time exceeds said threshold time.

12. The system of claim 11 wherein said detecting means comprises:

a light emitting diode emitting light energy in the visible spectrum upon said transfer ribbon;

a photologic sensor to detect a remnant portion of said light that passes through said ribbon, said sensor having a detection threshold; and a selectable resistor in series with said light emitting diode to adjust current therethrough to position said remnant portion above said threshold when said ribbon is clear and below said threshold when said ribbon is coated with any of a set of predetermined colors.

13. The system of claim 9 wherein said print station further includes:

a ribbon supply spool a ribbon takeup spool;

a stepper motor coupled to said takeup spool;

a clutch between said stepper motor and said takeup spool to control torque applied to said takeup spool by said stepper motor; and a brake on said supply spool to maintain tension on said ribbon.

14. The system of claim 9 wherein said plurality of printer modules mounted in succession includes printer modules alternately mounted along opposite first and second sides of said card path.

* * * * *